United States Patent [19]

Nilsson

[11] 3,977,143

[45] Aug. 31, 1976

[54] IMITATED JALOUSIE DOOR AND METHOD OF MANUFACTURING SAME

[75] Inventor: Karl Nilsson, Hjorted, Sweden

[73] Assignee: Aktiebolaget Tatebo Industrier, Hjorted, Sweden

[22] Filed: May 22, 1975

[21] Appl. No.: 580,024

[30] Foreign Application Priority Data

May 24, 1974 Sweden ..... 7406928

[52] U.S. Cl. ..... 52/473; 52/631; 52/741

[51] Int. Cl.[2] ..... E06B 7/08

[58] Field of Search ..... 52/631, 473, 741

[56] References Cited

UNITED STATES PATENTS

| | | | |
|---|---|---|---|
| 1,671,084 | 5/1928 | Meyercord | 52/631 |
| 3,055,467 | 9/1962 | Peek et al. | 52/473 X |
| 3,649,398 | 3/1972 | Keith | 52/631 UX |

FOREIGN PATENTS OR APPLICATIONS

| | | | |
|---|---|---|---|
| 260,801 | 4/1949 | Switzerland | 52/631 |

*Primary Examiner*—Ernest R. Purser
*Assistant Examiner*—Carl D. Friedman
*Attorney, Agent, or Firm*—James E. Nilles

[57] ABSTRACT

An imitated jalousie door or shutter including a frame having a jalousie block mounted therein and a method of making such a door. The jalousie block is constructed from a base plate of relatively non-bendable material having a thin bendable foil bonded to the front and back surfaces of the plate. A plurality of parallel V-shaped slots are cut in the front and back surface of the plate through one layer of foil and completely through the thickness of the plate but not through the second layer of foil. The block may then be folded in a zigzag or jalousied relation to be received and secured by the frame. A similar method is provided for forming the frame.

11 Claims, 5 Drawing Figures

IMITATED JALOUSIE DOOR AND METHOD OF MANUFACTURING SAME

BACKGROUND OF THE INVENTION

The present invention is directed to a jalousie of the type intended to be used as a door or a shutter or for any kind of practical or decorative purposes.

Jalousie doors have been previously manufactured by mounting ribs or laths of wood angularly or slopingly arranged in a row one after another between two spaced edge ribs. Such a jalousie door is expensive and complicated to manufacture in part since the jalousie laths have to be made of specially selected wood for decorative reasons, and the frame and the edge ribs on both sides have to be formed with cut grooves or similar means for each jalousie rib.

In many cases it may be desired to obtain an appearance similar to that of a jalousie door while disadvantages may be involved if the door or the shutter is more or less open as in a genuine jalousie. In such cases it may be convenient to manufacture a so called imitated jalousie which is formed with angularly mounted or sloping ribs, but in which the area between the lower edge of one rib and the upper edge of the next rib located underneath said first rib is covered by another rib.

Such an imitated jalousie is very expensive and complicated to manufacture and consequently attempts have been made to replace the jalousie ribs by a pleated jalousie block to be inserted or mounted in the door or the frame. Imitated jalousie doors or shutters have been previously proposed in which a jalousie block of pleated synthetic resin material has been inserted in the frame. In order to enable a suitable pleating of the jalousie block however the material must be thin or otherwise easily bendable, and for this reason the jalousie block itself has little resistance to bending and winding, and the composite door or shutter has a poor structural strength. Such previously proposed structures are therefore limited to rather small doors or shutters or limited to doors or shutters having wide and stable frames.

SUMMARY OF THE INVENTION

The present invention refers to a jalousie door comprising a frame having a jalousie block mounted therein which jalousie block is made of a plane base plate of a strong material which is resistant to bending and which is covered on both sides with a thin foil of a bendable material.

The invention also refers to a method of manufacturing a jalousie door of the above mentioned kind.

The present invention overcomes the problem of providing an imitated jalousie door or shutter in which the jalousie block has substantially the same good bending and winding strength as conventional jalousie doors and shutters and which jalousie doors or shutters are not restricted for strength reasons to doors or shutters having small dimensions or wide stable frames, and whereby the jalousie block may be manufactured quickly and easily in various optional dimensions and at comparatively low costs.

The invention will now be described in more detail with reference to the accompanying drawings which illustrate an embodiment of the invention as one example thereof.

DESCRIPTION OF THE PREFERRED EMBODIMENT

Figure 1:
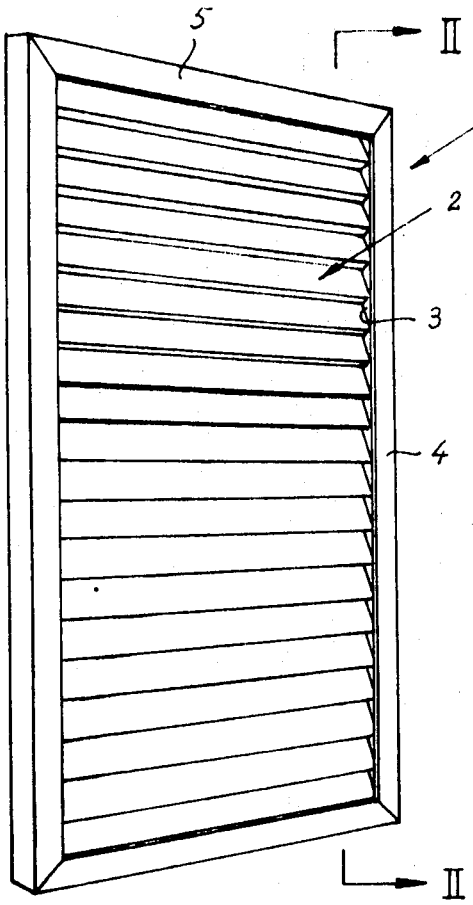
FIG. 1 is a perspective view of a jalousie shutter manufactured in accordance with the invention.

The jalousie shutter shown in FIG. 1 generally comprises a rectangular frame 1 having an imitated jalousie block 2 inserted therein. In this case the frame 1 is formed with an inner groove 3 in which the jalousie block 2 is secured, and the frame comprises two long sides 4 and two short sides 5 having mitred corners.

The frame 1 and the jalousie block 2 are manufactured as two separate units, and during manufacturing of the frame 2, one side thereof is kept open in order to enable insertion of the jalousie block 2 into the grooves 3, whereupon the last side of the frame 2 is mounted.

The jalousie block 2 includes a base plate 6 constructed of a material which is rather strong and resistant to bending like wood, board, plywood, particle board or like material. The base plate 6 is covered on both sides with a foil of a thin material, for instance a suitable plastic material, which is relatively bendable. The base plate 6 may also be constructed from laminated materials. The foil covering 7 may be glued, pressed or in any other way bonded to the whole base plate 6.

When manufacturing the jalousie block 2 the base plate 6 of wood, board, plywood, particle board or similar, is covered on both sides with a surface covering of a thin foil 7 of material which is relatively bendable and which is bonded to the complete surface of the base plate 6. The base plate 6 having a bonded thin foil covering 7 is then cut into suitable dimensions to form the shutter or door to be provided with the imitated jalousie block. After the base plate 6 is cut to the intended dimension, V-formed grooves 8 are cut at the upper side of the plate straight across the width of the jalousie block 2 to be made. The groves 8 are cut so as to extend through the covering 7 on one side of the base plate 6 and through substantially the whole thickness of the base plate 6 but not through the covering 7 at the underside of the plate. The distance between two such grooves 8 is equal to the combined width of one of the vertical surfaces 9 plus one of the horizontal surfaces 10 as shown in FIG. 2.

In the same way V-formed grooves 11 are cut from the opposite side of the plate 6 and extending through the covering 7 bonded to the underside of the plate and through substantially the whole base plate 6 but not through the covering 7 bonded to the upper side of the plate. The distance between the grooves 11 is the same as the distance between the grooves 8 but they are offset in relation to the grooves 8 so as to give the intended dimension of the vertical surface 9 and the horizontal surface 10 respectively.

By varying the angle of the V-grooves 8 and 11 the appearance of the jalousie block may be varied in that an angle of 90° gives a straight angle between the vertical portion 9 and the horizontal portion 10, an angle of more than 90° gives a blunt angle and a narrower angle than 90° gives an acute angle. By forming the grooves 8 and 11 to be converging or diverging in relation to each other, it is possible to provide a generally bow formed jalousie block.

Figure 2:
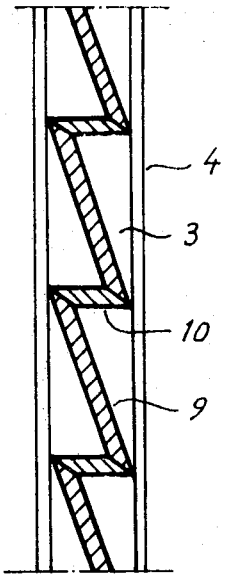
FIG. 2 is a cross section view of the jalousie shutter shown in FIG. 1 seen along line II — II.
Figure 3:
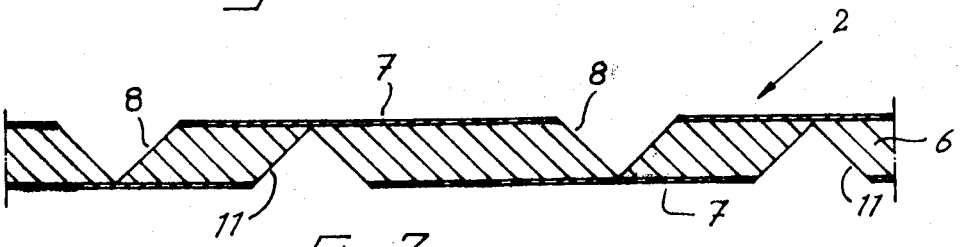
FIG. 3 diagramatically illustrates a step of the method of manufacturing the jalousie shutter according to the invention.

After the grooves 8 and 11 have been cut the jalousie block 2 is folded to form a zigzag design as illustrated in FIG. 2 whereby the covering foils 7 act as connecting and hinge forming means. The jalousie block 2 folded to the zigzag form is thereafter pushed into the grooves 3 of the frame 1, and finally the jalousie is blocked by attaching the last side of the frame.

In case a particularly great strength is desired, glue or similar material may be applied in the butt joint formed by the edges of the cut grooves 8 and 11 when the jalousie block 2 is folded. By doing this a rigid jalousie block 2 is obtained which may be used separately or with only a very thin frame 1.

Figure 5:
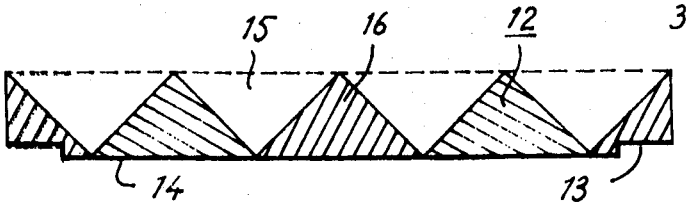
FIG. 5 shows a blank for the frame in a cross section illustrating the method of making the frame.
Figure 4:
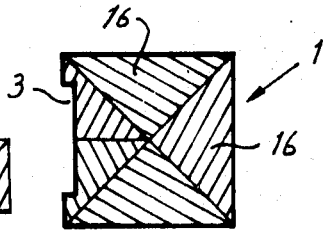
FIG. 4 shows a cross section through the frame of FIG. 1.

As illustrated in FIGS. 4 and 5, frame 1 may be made by a method similar to the one described above in connection to the jalousie block. The frame blank may be a piece of particle board 12, the width of which corresponds to the total perimeter of a cross-section of the frame. At the two opposite edges the board 12 is formed with cuttings 13, and the side of the board 12 including the cuttings 13 is covered with a thin and bendable foil 14 similar to the foil 7 of the jalousie block 2. The foil 14 is bonded to board 12 in the same manner that foil 7 is bonded to the block 2. At the opposite side cuts 15 are made completely through the board 12 but not through the foil 14 so as to form triangles 16 which together form the frame 1 with the groove 3 as shown in FIG. 4. Preferably the triangles 16 of the board are glued together to form a solid unit. In order to provide the different sides of the frame, the said unit is mitred and three sides are glued together leaving one side open to push the jalousie block into the grooves 3 of the frame, whereupon the fourth side of the frame is connected to the first side thereof so as to block the jalousie within the frame.

The method according to the invention makes it possible to manufacture an imitated jalousie by a simple, quick and cheap method giving a jalousie block of great strength, and by which the jalousie may be given any suitable form and size, and in which the jalousie may be made of a strong but still rather inexpensive material. The jalousie may also be made of veneered wood. Due to the cutting of the grooves, it is not necessary to form the grooves parallel with the grain of the veneer. For example, grooves may be made perpendicularly to the grain, so that the appearance of the ready jalousie may be further varied.

I claim:

1. An imitated jalousie comprising a frame having a jalousie block mounted therein, said frame having a groove therein, said jalousie block including a base plate having opposed front and back surfaces and being constructed from a strong material which is resistant to bending and a thin foil of a bendable material bonded to each of said surfaces, said block further including V-formed cuts cut in said surfaces, each of said cuts disposed transversely to said groove and extending through the foil bonded to one surface and through the base plate but not through the foil of the opposed surface, said block being folded in a zigzag form and mounted in said groove in the frame, and means on said frame for maintaining said block folded in zigzag form, thereby providing a tight, solid jalousie unit.

2. An imitated jalousie as set forth in claim 1, characterized in that said V-formed cuts are parallel with each other and form a plurality of parallel hinged jalousie portions hingedly joined by said bendable foil.

3. An imitated jalousie set forth in claim 1 characterized in that said V-formed cuts define obtuse angles and said folded block provides a bow formed jalousie block.

4. An imitated jalousie as set forth in claim 2 characterized in that said V-formed cuts define angles of more than 90° whereby said parallel hinged jalousie portions may be folded to define acute angles therebetween.

5. An imitated jalousie as set forth in claim 2 characterized in that said parallel hinged jalousie portions of the jalousie block are glued together thereby providing a solid unit.

6. A method of manufacturing an imitated jalousie so as to include a frame having a jalousie block mounted therein comprising the steps of covering a base plate on both sides thereof with a thin bendable foil material and bonding said foil thereto, said base plate being formed from a strong material resistant to bending, cutting V-formed grooves at predetermined places alternately on each side of the foil covered base plate, said cuts passing through the foil at the cut side and through the base plate but not through the foil on the opposite side, folding said cut plate into a zigzag design along the cut V-grooves, and securing the folded plate in its zigzag design by means of said frame.

7. The method set forth in claim 6 wherein said thin bendable foil is glued onto the complete surface of both sides of the base plate.

8. The method as set forth in claim 6 wherein the thin bendable foil is made of a plastic material.

9. The method as set forth in claim 6 wherein said V-grooves are cut so as to define an acute angle.

10. The method as set forth in claim 6 wherein the jalousie block is introduced into and locked within a groove in said frame whereby said jalousie block is fixed in a zigzag design.

11. The method set forth in claim 6 wherein the V-formed grooves extend in parallel relation with each other.

* * * * *